United States Patent [19]

Drogo

[11] Patent Number: 4,886,474

[45] Date of Patent: Dec. 12, 1989

[54] SPINDLE-RECEIVING JACK FOR FORMING AN ELECTRICAL CONNECTION AND ELECTRICAL CONNECTOR COMPRISING AT LEAST ONE SUCH JACK

[76] Inventor: Pierre L. M. Drogo, 45570 Ouzouer Sur, Loire, France

[21] Appl. No.: 228,125

[22] Filed: Aug. 4, 1988

[30] Foreign Application Priority Data

Aug. 14, 1987 [FR] France ..... 87 11596

[51] Int. Cl.[4] ..... H01R 11/22

[52] U.S. Cl. ..... 439/856; 439/842

[58] Field of Search ..... 439/825, 851, 852, 856, 439/857, 839, 842–845, 833

[56] References Cited

U.S. PATENT DOCUMENTS

| | | | |
|---|---|---|---|
| 3,065,450 | 11/1962 | Fieberg | 439/825 |
| 3,181,112 | 4/1965 | Bonhomme | 439/825 |
| 4,068,917 | 1/1978 | Seidler | 439/852 |

FOREIGN PATENT DOCUMENTS

| | | | |
|---|---|---|---|
| 2516423 | 10/1976 | Fed. Rep. of Germany | 439/851 |
| 1336585 | 7/1963 | France . | |
| 2596588 | 10/1987 | France . | |

*Primary Examiner*—David Pirlot

*Attorney, Agent, or Firm*—Kenyon & Kenyon

[57] ABSTRACT

The present invention concerns a spindle-receiving jack for forming an elecrtrical connection, the said jack comprising at least three resilient tongues defining an opening for forcibly passing the stem of the spindle and shaped in such a manner that each of them has its own resonance frequency.

2 Claims, 1 Drawing Sheet

SPINDLE-RECEIVING JACK FOR FORMING AN ELECTRICAL CONNECTION AND ELECTRICAL CONNECTOR COMPRISING AT LEAST ONE SUCH JACK

BACKGROUND OF THE INVENTION

The present invention concerns a spindle-receiving jack for forming an electrical connection as well as an electrical connector comprising at least one such jack.

The present invention finds application in the devices for connecting electrical cables intended to carry high speed information signals as is the case for example for the control and monitoring apparatus used in airplanes.

A spindle-receiving jack of this kind is known which comprises two or more identical resilient tongues defining a cylindrical opening for forcibly passing the stem of the spindle.

However, such an electrical connection is submitted to micro-cutoffs of the electrical information signal when outer vibrations occur at a frequency corresponding to the resonance frequency of the resilient tongues.

SUMMARY OF THE INVENTION

The present invention has as an object to eliminate the above drawback by providing a receiving jack which, once connected to a corresponding spindle, ensures an extremely reliable electrical connection which is therefore not subjected to micro-cutoffs.

For this purpose, the jack according to the present invention is characterized in that it comprises at least three resilient tongues defining an opening for forcibly passing the stem of the spindle and shaped in such a manner that each of them has its own resonance frequency.

According to a feature of the invention, the resilient tongues are disposed around the axis of the jack so as to define respectively arcs of a circle having different lengths.

DETAILED DESCRIPTION

Figure 1:
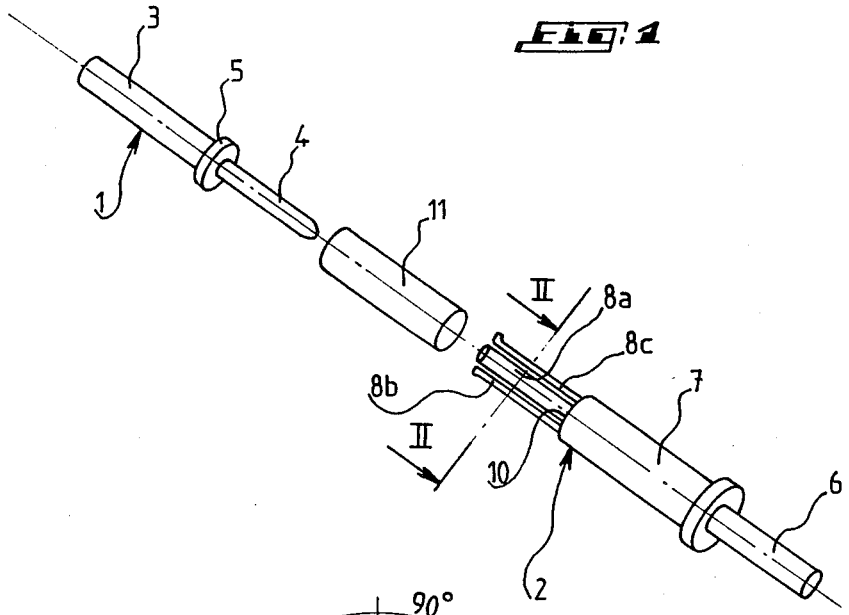
FIG. 1 is a perspective view of the constitutive elements separated from one another of an electrical connection according to the invention.
Figure 2:
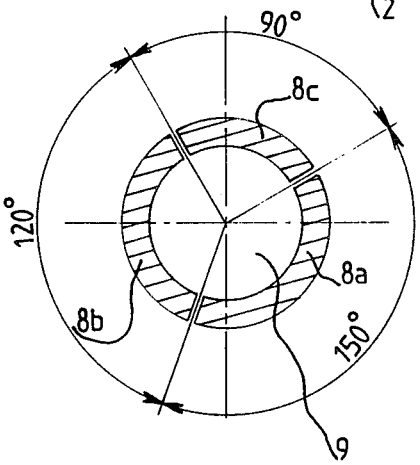
FIG. 2 is a cross-sectional view along line II—II in FIG. 1.

Referring to the Figures, reference sign 1 designates a metallic spindle of an electrical connection intended to enter a metallic jack 2.

Spindle 1 comprises a tubular part 3 in which is fastened the uninsulated end of a wire (not shown) and a stem 4 extending tubular part 3. The uninsulated end of the wire is fastened in tubular part 3 for example by soldering or by crimping the tubular part. Spindle 1 comprises also a flange 5 near its middle connecting portion between tubular part 3 and stem 4.

Jack 2 comprises also a tubular part 6 for receiving the uninsulated end of a wire (not shown) and extended by a cylindrical solid part 7, the end of which is solid with three resilient tongues 8*a*–8*c* having the same length and defining an approximately cylindrical opening 9 for forcibly passing spindle stem 4, which opening is coaxial with the longitudinal axis of jack 2. Jack 2 comprises also a shoulder 10 at the junction between resilient tongues 8*a*–8*c* and cylindrical part 7.

The resilient tongues 8*a*–8*c* are disposed round the axis of jack 2 so as to define respectively arcs of a circle having different lengths. In the present case, the angles which intercept the three arcs of a circle of resilient tongues 8*a*–8*c* have respectively values of about 90°, 120° and 150°.

As resilient tongues 8*a*–8*c* have different geometric configurations, each of them has its own value of resonance frequency. Therefore, when an electrical connection is formed between spindle 1 and jack 2 and when the latter is submitted to a vibration the frequency of which corresponds to the resonance frequency of one of the three resilient tongues, the two other resilient tongues will maintain the electrical contact with the stem 4 of spindle 1 since each of them has a resonance frequency which is different from the frequency of the vibration.

Although jack 1 has been described as comprising three resilient metallic tongues, it is obvious that it can be designed so as to comprise four, five or more resilient tongues distributed around the axis of the jack so as to define respectively arcs of a circle having different lengths or arcs of a circle inscribed respectively in angles at center having different values.

FIG. 1 shows a protection sleeve 11 which, once the electrical connection assembled, surrounds coaxially tongues 8*a*–8*c* and abuts at both ends between flange 5 of spindle 1 and shoulder 10 of jack 2.

The invention is useful in particular for the electrical connectors whose plug comprises a plurality of spindles 1 and whose socket comprises a plurality of jacks 2 according to the invention.

What is claimed is:

1. A spindle-receiving jack for forming an electrical connection through which high speed information signals flow, comprising: three resilient tongues defining a central opening for receiving a stem of a spindle which is forcibly introduced therein, wherein said resilient tongues are coaxially distributed around a longitudinal axis of the jack and define arcs of a circle, each arc inscribed with an angle at the center of the axis, each angle having a different value, each resilient tongue having its own reasonance frequency defined by its respective angle, the jack maintaining said electrical connection through two of the resilient tongues in electrical contact with the stem of said spindle when the electrical connection is subjected to an external vibration, the frequency of which corresponds to the resonance frequency of the third resilient tongue, whereby said electrical connection is not subjected to micro-cutoffs.

2. An electrical connector, for connecting therebetween electrical cables of control and monitoring apparatuses used in particular in an airplance and intended to carry high speed information, comprising:

a plug having a plurality of spindles; and a socket having a plurality of jacks each for receiving one of the spindles, and, for forming electrical connections with said spindles wherein, each spindle-receiving jack comprises three resilient tongues defining a central opening for receiving a stem of a corresponding spindle which is forcibly introduced therein, wherein said resilient tongues are coaxially distributed around a longitudinal axis of the jack and define arcs of circle, each arc inscribed with an angle having a different value, each resilient tongue having its own resonance frequency defined by its respective angle, the jack maintaining said electrical connection through two of the resilient tongues in electrical contact with the stem of the corresponding spindle when the electrical connection is subjected to an external vibration, the frequency of which corresponds to the resonance frequency of the third resilient tongue, whereby said electrical connection is not subjected to micro-cutoffs.

* * * * *